US009903369B2

(12) United States Patent
Kwak et al.

(10) Patent No.: US 9,903,369 B2
(45) Date of Patent: Feb. 27, 2018

(54) VANE ROTARY COMPRESSOR HAVING HINGE RECEIVING PORTIONS FORMED ON AN OUTER PERIPHERAL SURFACE OF A ROTOR WITH A PLURALITY OF VANES INCLUDING A HINGE PORTION AND A BLADE PORTION

(71) Applicant: HANON SYSTEMS, Daejeon (KR)

(72) Inventors: Jung Myung Kwak, Daejeon (KR); Kweon Soo Lim, Daejeon (KR); Seon Joo Hong, Daejeon (KR)

(73) Assignee: HANON SYSTEMS, Daejeon-si (KR)

( * ) Notice: Subject to any disclaimer, the term of this patent is extended or adjusted under 35 U.S.C. 154(b) by 0 days.

(21) Appl. No.: 14/766,763

(22) PCT Filed: May 26, 2014

(86) PCT No.: PCT/KR2014/004653
§ 371 (c)(1),
(2) Date: Aug. 10, 2015

(87) PCT Pub. No.: WO2015/129961
PCT Pub. Date: Sep. 3, 2015

(65) Prior Publication Data

US 2016/0265531 A1 Sep. 15, 2016

(30) Foreign Application Priority Data

Feb. 28, 2014 (KR) ..... 10-2014-0024520

(51) Int. Cl.
*F03C 4/00* (2006.01)
*F04C 2/00* (2006.01)
(Continued)

(52) U.S. Cl.
CPC ..... *F04C 18/44* (2013.01); *F01C 21/0809* (2013.01); *F01C 21/0863* (2013.01);
(Continued)

(58) Field of Classification Search
CPC ..... F04C 18/321; F04C 18/324; F04C 18/44; F04C 2/321; F04C 2/324; F04C 2/44;
(Continued)

(56) References Cited

U.S. PATENT DOCUMENTS 2,487,685 A * 11/1949 Young ..... F04C 2/44 418/152
5,346,234 A * 9/1994 Kadaja ..... F01C 21/0845 418/266
2010/0226809 A1* 9/2010 Kadaja ..... F01C 21/0809 418/259

FOREIGN PATENT DOCUMENTS

GB 191319570 0/1914
GB 957593 5/1964
(Continued)

*Primary Examiner* — Theresa Trieu
(74) *Attorney, Agent, or Firm* — James D. Miller; Shumaker, Loop & Kendrick, LLP

(57) ABSTRACT

Disclosed herein is a vane rotary compressor in which a fluid such as a refrigerant is compressed while a volume of a compression chamber is reduced during rotation of a rotor. There is provided a vane rotary compressor capable of preventing a delay of rotation operation of a vane by respectively forming oil films on both sides of a hinge portion of the vane in a rotation direction thereof and smoothly sliding the hinge portion.

16 Claims, 4 Drawing Sheets

(51) Int. Cl.

| | |
|---|---|
| ***F04C 18/00*** | (2006.01) |
| ***F04C 18/44*** | (2006.01) |
| ***F04C 18/32*** | (2006.01) |
| ***F01C 21/08*** | (2006.01) |
| ***F04C 29/02*** | (2006.01) |
| ***F04C 29/00*** | (2006.01) |
| *F04C 29/06* | (2006.01) |

(52) U.S. Cl.
CPC ..... *F04C 18/321* (2013.01); *F04C 29/0085* (2013.01); *F04C 29/02* (2013.01); *F04C 29/06* (2013.01)

(58) Field of Classification Search
CPC ..... F04C 29/02; F04C 29/06; F01C 21/0809; F01C 21/0863
USPC ..... 418/259, 266–268, 93, 99
See application file for complete search history.

(56) References Cited

FOREIGN PATENT DOCUMENTS

| | | | | | |
|---|---|---|---|---|---|
| GB | 2154283 | A | * | 9/1985 | ..... F01C 1/44 |
| JP | 2002130169 | A | | 5/2002 | |
| JP | 2010031759 | A | | 2/2010 | |
| KR | 1020050118392 | A | | 12/2005 | |
| KR | 1020130094651 | A | | 8/2013 | |
| KR | 1020130121326 | A | | 11/2013 | |

* cited by examiner

VANE ROTARY COMPRESSOR HAVING HINGE RECEIVING PORTIONS FORMED ON AN OUTER PERIPHERAL SURFACE OF A ROTOR WITH A PLURALITY OF VANES INCLUDING A HINGE PORTION AND A BLADE PORTION

CROSS-REFERENCE TO RELATED APPLICATIONS

This patent application is a United States national phase patent application based on PCT/KR2014/004653 filed May 26, 2014 which claims the benefit of Korean Patent Application No. 10-2014-0024520 filed Feb. 28, 2014. The entire disclosures of the above patent applications are hereby incorporated herein by reference.

FIELD OF THE INVENTION

The present invention relates to a vane rotary compressor in which a fluid such as refrigerant is compressed while the volume of a compression chamber is reduced when a rotor rotates.

BACKGROUND OF THE INVENTION

A vane rotary compressor is used for an air conditioner and the like, and compresses a fluid such as refrigerant to supply the compressed fluid to the outside.

FIG. 1 is a cross-sectional view schematically illustrating a conventional vane rotary compressor disclosed in Japanese Patent Laid-open Publication No. 2010-31759 (Patent Document 1). FIG. 2 is a cross-sectional view taken along line A-A in FIG. 1.

As illustrated in FIG. 1, the conventional vane rotary compressor, which is designated by reference numeral 10, includes a housing H, which is configured of a rear housing 11 and a front housing 12 while defining the external appearance thereof, and a cylindrical cylinder 13 which is received within the rear housing 11.

In this case, the cylinder 13 has an inner peripheral surface having an oval sectional shape as illustrated in FIG. 2.

In the inside of the rear housing 11, a front cover 14 is coupled to the front of the cylinder 13 and a rear cover 15 is coupled to the rear of the cylinder 13. A discharge space Da is defined between the outer peripheral surface of the cylinder 13, the inner peripheral surface of the rear housing 11 facing the same, the front cover 14, and the rear cover 15.

A rotary shaft 17 is rotatably installed to the front cover 14 and the rear cover 15 through the cylinder 13. The rotary shaft 17 is coupled with a cylindrical rotor 18, and the rotor 18 rotates in the cylinder 13 along with the rotary shaft 17 when the rotary shaft 17 rotates.

As illustrated in FIG. 2, a plurality of slots 18*a* are radially formed on the outer peripheral surface of the rotor 18, a linear type vane 20 is slidably received in each of the slots 18*a*, and lubricant oil is supplied into the slot 18*a*.

When the rotor 18 is rotated by the rotation of the rotary shaft 17, a tip portion of the vane 20 protrudes outward from the slot 18*a* and comes into close contact with the inner peripheral surface of the cylinder 13. In this case, a plurality of compression chambers 21 are divided and formed, each of which is defined by the outer peripheral surface of the rotor 18, the inner peripheral surface of the cylinder 13, a pair of adjacent vanes 20, and a facing surface 14*a* of the front cover 14 and a facing surface 15*a* of the rear cover 15, which face the cylinder 13.

In the vane rotary compressor, an intake stoke is a stroke in which the volume of the compression chamber 21 is enlarged whereas a compression stroke is a stroke in which the volume of the compression chamber 21 is reduced, according to the rotation direction of the rotor 18.

As illustrated in FIG. 1, a suction port 24 is formed at the upper portion of the front housing 12, and a suction space Sa communicating with the suction port 24 is defined within the front housing 12.

The front cover 14 is formed with an inlet 14*b* which communicates with the suction space Sa, and a suction passage 13*b*, which communicates with the inlet 14*b*, is formed to axially pass through the cylinder 13.

As illustrated in FIG. 2, discharge chambers 13*d*, which are recessed inwards, are formed at the opposite sides of the outer peripheral surface of the cylinder 13. In this case, the pair of discharge chambers 13*d* communicate with the compression chambers 21 through associated discharge holes 13*a*, and forms a portion of the discharge space Da.

The rear housing 11 is formed with a high-pressure chamber 30 which is divided by the rear cover 15 and into which a compressed refrigerant is introduced. That is, the inside of the rear housing 11 is divided into the discharge space Da and the high-pressure chamber 30 by the rear cover 15. In this case, any one of the pair of discharge chambers 13*d* is formed with an outlet 15*e* which communicates with the high-pressure chamber 30.

Accordingly, when the rotor 18 and the vanes 20 rotate along with the rotation of the rotary shaft 17, a refrigerant is sucked from the suction space Sa via the inlet 14*b* and the suction passage 13*b* into each compression chamber 21. The refrigerant compressed by the reduction in volume of the compression chamber 21 is discharged to the discharge chamber 13*d* through the associated discharge hole 13*a* to be introduced into the high-pressure chamber 30 through the outlet 15*e*, and is then supplied to the outside through a discharge port 31.

Meanwhile, the high-pressure chamber 30 is provided with an oil separator 40 for separating the lubricant oil from the compressed refrigerant introduced into the high-pressure chamber 30. An oil separation pipe 43 is installed at the upper portion of a case 41, and an oil separation chamber 42, into which the separated oil is dropped, is formed in the lower portion of the oil separation pipe 43. The oil in the oil separation chamber 42 flows down into an oil storage chamber 32, which is formed in the lower portion of the high-pressure chamber 30, through an oil passage 41*b*.

The oil stored in the oil storage chamber 32 lubricates a sliding surface between the rear cover 15 and rotor 18 via a lubrication space of a bush, which supports the rear end of the rotary shaft 17, through an oil supply passage 15*d*. Subsequently, the oil is reintroduced into the outlet 15*e* through an oil return groove 45 by a difference in pressure between the discharge space Da and the high-pressure chamber 30.

In the case of applying the linear type vane 20 to the conventional vane rotary compressor 10, since the vane 20 protrudes outward of the rotor 18 along the slot 18*a*, the tip portion of the vane 20 strikes the inner peripheral surface of the cylinder 13, thereby causing strike noise.

FIG. 3 is a cross-sectional view schematically illustrating a curved blade type vane rotary compressor disclosed in Japanese Patent Laid-open Publication No. 2002-130169 (Patent Document 2).

The vane rotary compressor illustrated in FIG. 3 includes a cylindrical cylinder 1, a rotor 2, and a drive shaft 3. In this case, the cylinder 1 includes an inlet 1A and an outlet 1B and the rotor 2 is eccentrically installed in the cylinder 1.

A plurality of curved blade type vanes 4 are provided on the outer peripheral surface of the rotor 2 so that a plurality of compression chambers 6 are divided and formed between the cylinder 1 and the rotor 2. One side of each of the vanes 4 is hinge-coupled to the outer peripheral surface of the rotor 2 by a hinge pin 5.

While the rotor 2 rotates by a predetermined angle from a time, at which a compression stroke ends when the vane 4 passes through the outlet 1B, to a time, at which an intake stroke begins when the vane 4 passes through the inlet 1A, the back portion of the vane 4 is pressed toward rotor 2 by the inner peripheral surface of the cylinder 1 as illustrated in the enlarged view of FIG. 3. In this case, the tip portion of the vane 4 is spaced apart from the inner peripheral surface of the cylinder 1.

Subsequently, when the force applied to the back portion of the vane 4 is instantaneously removed as a gap between the outer peripheral surface of the rotor 2 and the inner peripheral surface of the cylinder 1 is increased by rotation of the rotor 2, the tip portion of the vane 4 comes into contact with the inner peripheral surface of the cylinder 1 while the vane 4 pivots and is unfolded from the rotor 2.

In this case, when the vane 4 folded by the rotor 2 is unfolded toward the inner peripheral surface of the cylinder 1 due to an increase in rotational moment of inertia of the vane 4 during the high-speed rotation of the rotor 2, the tip portion of the vane 4 strikes the inner peripheral surface of the cylinder 1, thereby causing strike noise.

In addition, the back portion of the vane 4 comes into contact with the inner peripheral surface of the cylinder 1 at the initial stage of the intake stroke and the vane 4 is rapidly unfolded from the rotor 2 after the intake stroke somewhat proceeds, so that the tip portion of the vane 4 is supported by the inner peripheral surface of the cylinder 1. Therefore, the volume of the compression chamber 6 is not smoothly expanded, resulting in a reduction of suction flow rate.

This description will be given in more detail with reference to FIG. 4.

FIG. 4 is a partially enlarged view schematically illustrating forces acting on the curved blade type vane during the rotation of the rotor in FIG. 3.

In the vane rotary compressor illustrated in FIGS. 3 and 4, the vane 4 is unfolded from the outer peripheral surface of the rotor 2 during the rotation of the rotor 2. In this case, the tip portion of the vane 4 comes into close contact with the inner peripheral surface of the cylinder 1 so that the compression chamber 6 is defined between the pair of adjacent vanes 4.

The forces acting on the vane 4 will be described according to the action directions thereof with reference to FIG. 4. Centrifugal force A1 according to the rotation of the rotor 2 and rotational moment A2 according to a center of gravity M of the vane 4 act as forces of pushing and rotating the tip portion of the vane 4 toward the inner peripheral surface of the cylinder 1.

On the contrary, hinge friction force B1 of the vane 4, rotational moment of inertia B2, fluid resistance B3 in refrigerant of the compression chamber 6, friction force B4 between the vane 4 and the cylinder 1, and viscosity B5 of lubricant oil act as forces of pulling the tip portion of the vane 4 toward the outer peripheral surface of the rotor 2.

In this case, when the forces B1 to B5 of pulling the tip portion of the vane 4 toward the outer peripheral surface of the rotor 2 are larger than the forces A1 and A2 of pushing the tip portion of the vane 4 toward the inner peripheral surface of the cylinder 1, a gap is formed between the tip portion of the vane 4 and the inner peripheral surface of the cylinder 1.

In this case, the compression chamber 6 is not fully sealed by the vane 4 and an inner leakage occurs between the compression chamber 6 and the adjacent compression chamber 6, thereby causing a reduction of compression flow rate of the refrigerant.

In addition, the gap between the vane 4 and the cylinder 1 is gradually increased during a delay of rotation operation of the vane 4. Accordingly, there is a problem in that strike noise is caused when the tip portion of the vane 4 instantaneously comes into contact with the inner peripheral surface of the cylinder 1 due to the centrifugal force A1 according to the rotation of the rotor 2 and the rotational moment A2 of the vane 4.

In connection with the hinge friction force B1 of the vane 4, friction force is concentrated on a friction point Pf at which a hinge portion 4*a* of the vane 4 comes into contact with the outer peripheral surface of the rotor 2 when the vane 4 is unfolded. In this case, since an oil film 7 is formed only on one side of the friction point Pf, a reduction in friction force by lubricant oil may be decreased.

That is, when the hinge portion 4*a* of the vane 4 is hinge-coupled to a receiving groove 2*a* on the outer peripheral surface of the rotor 2, a portion of the hinge portion 4*a* is exposed outward from the outer peripheral surface of the rotor 2. Thus, the friction point Pf is formed on the sharp edge of the receiving groove 2*a* coming into contact with the hinge portion 4*a* during the rotation of the hinge portion 4*a*, and the oil film 7 by lubricant oil is formed only in the front region of the hinge portion 4*a* in the rotation direction thereof on the basis of the friction point Pf.

[Patent Document 1] JP2010-031759A (Feb. 12, 2010)

[Patent Document 2] JP2002-130169A (May 9, 2002)

SUMMARY OF THE INVENTION

Accordingly, the present invention has been made in view of the above-mentioned problem, and an object thereof is to provide a vane rotary compressor capable of preventing strike noise due to a delay of rotation operation of a vane during the rotation of a rotor by reducing hinge friction force of the vane and of enhancing performance of the compressor by decreasing an inner leakage.

Technical Solution

In accordance with an aspect of the present invention, a vane rotary compressor includes a housing having a hollow cylinder therein, a rotor installed in the cylinder and rotating by receiving power of a drive source by a rotary shaft, a plurality of slots being formed on an outer peripheral surface of the rotor, and a plurality of vanes dividing a hollow of the cylinder into a plurality of compression chambers, each of the vanes including a hinge portion, hinge-coupled to one side of each of the slots, and a blade portion extending from the hinge portion to rotate toward an inner peripheral surface of the cylinder, wherein one side of the outer peripheral surface of the rotor is formed with a hinge receiving portion enclosing a circumference of the hinge portion, and the hinge portion is received inside the outer peripheral surface of the rotor by the hinge receiving portion.

Here, a friction point between the binge portion and the hinge receiving portion may be circumferentially inwardly spaced apart from an end of an inner peripheral surface of the hinge receiving portion.

In addition, an end portion of the binge receiving portion may pass an extension line joining a central point of the rotor and a central point of the hinge portion and extend along the circumference of the hinge portion in a rotation direction of the rotor.

In this case, an angle formed by the central point of the rotor and the end of the inner peripheral surface of the hinge receiving portion with respect to the central point of the hinge portion may be between more than 180° and equal to or less than 230°.

In addition, on the basis of the friction point between the hinge portion and the hinge receiving portion, oil films may be formed in the front and rear of the hinge portion in a rotation direction thereof.

In this case, the oil films may be respectively formed in gaps between the hinge portion and the hinge receiving portion at both sides of the friction point.

In addition, a plurality of oil film formation spaces may be formed in a gap between the inner peripheral surface of the hinge receiving portion and an outer peripheral surface of the hinge portion, on the basis of the friction point.

In accordance with another aspect of the present invention, a vane rotary compressor includes a housing having a hollow cylinder therein, a rotor installed in the cylinder and rotating by receiving power of a drive source by a rotary shaft, a plurality of slots being formed on an outer peripheral surface of the rotor, and a plurality of vanes dividing a hollow of the cylinder into a plurality of compression chambers, each of the vanes including a hinge portion, hinge-coupled to one side of each of the slots, and a blade portion extending from the hinge portion to rotate toward an inner peripheral surface of the cylinder, wherein, during unfolding of the vanes, a friction point of the hinge portion is formed on an extension line joining a central point of the rotor and a central point of the hinge portion.

Here, one side of the outer peripheral surface of the rotor may be formed with a hinge receiving portion enclosing a circumference of the hinge portion, and the friction point may be a point at which one side of an outer peripheral surface of the hinge portion comes into contact with one side of an inner peripheral surface of the hinge receiving portion.

In addition, a plurality of oil film formation spaces may be formed in a gap between the inner peripheral surface of the hinge receiving portion and the outer peripheral surface of the hinge portion.

In this case, the oil film formation spaces may be separated from each other by the friction point.

In addition, at both sides of the friction point, oil films may be formed in gaps between the outer peripheral surface of the hinge portion and the inner peripheral surface of the hinge receiving portion.

In this case, a hinge portion imaginary circle, forming an outer peripheral surface of the hinge portion, may be formed in an inner region of a rotor imaginary circle forming the outer peripheral surface of the rotor.

In addition, a hinge portion imaginary circle, forming an outer peripheral surface of the hinge portion, may be formed in an outer region of a rotor imaginary circle forming the outer peripheral surface of the rotor.

In accordance with a further aspect of the present invention, a vane rotary compressor includes a housing having a hollow cylinder therein, a rotor installed in the cylinder and rotating by receiving power of a drive source by a rotary shaft, a plurality of slots being formed on an outer peripheral surface of the rotor, each of the slots having a hinge portion receiving groove, and a plurality of vanes dividing a hollow of the cylinder into a plurality of compression chambers, each of the vanes including a hinge portion, hinge-coupled to hinge portion receiving groove, and a blade portion extending from the hinge portion to rotate toward an inner peripheral surface of the cylinder, wherein the hinge portion receiving groove is radially inwardly spaced apart from the outer peripheral surface of the rotor such that a circumference of the hinge portion is received inside the outer peripheral surface of the rotor.

Here, a binge receiving portion may be extendedly formed on one side of the outer peripheral surface of the rotor so as to enclose the radially outward circumference of the hinge portion receiving groove.

In this case, during unfolding of the vanes, a friction point, at which the hinge portion comes into contact with the hinge receiving portion, may be formed on one side of an inner peripheral surface of the hinge receiving portion.

In addition, oil films may be formed in gaps between an outer peripheral surface of the hinge portion and the inner peripheral surface of the hinge receiving portion, and the oil films may be respectively formed on both sides of the friction point.

In this case, the friction point may be formed on an extension line joining a central point of the rotor and a central point of the hinge portion.

In this case, an angle formed by a central point of the rotor and an end of an inner peripheral surface of the hinge receiving portion with respect to a central point of the hinge portion may be between more than 180° and equal to or less than 230°.

Additional advantages, objects, and features of the invention will be set forth in part in the description which follows and in part will become apparent to those having ordinary skill in the art upon examination of the following or may be learned from practice of the invention.

BRIEF DESCRIPTION OF DRAWINGS

The above and other objects, features and other advantages of the present invention will be more clearly understood from the following detailed description taken in conjunction with the accompanying drawings, in which.

DETAILED DESCRIPTION OF EXEMPLARY EMBODIMENTS OF THE INVENTION

Figure 1:
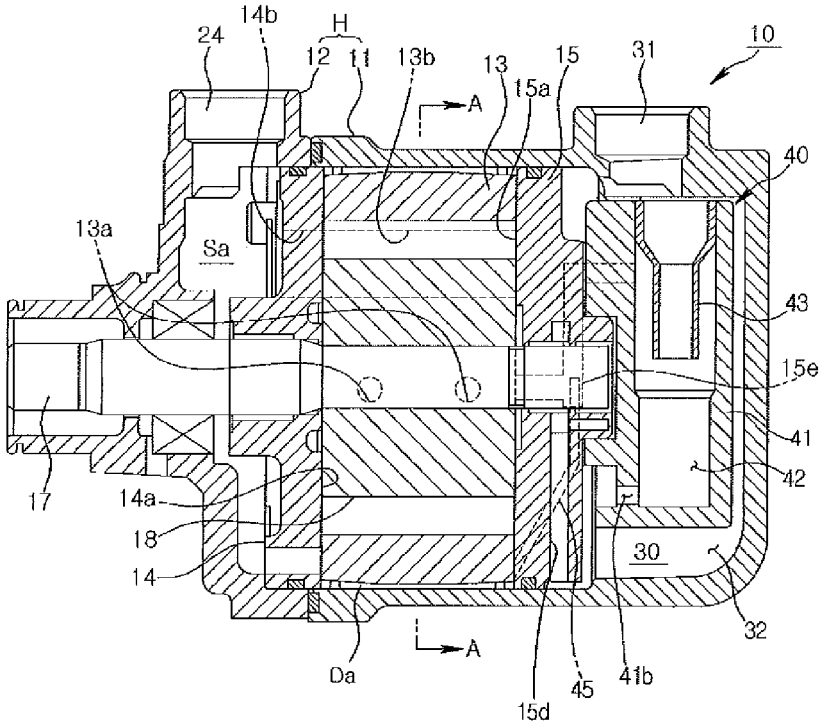
PRIOR ART FIG. 1
FIG. 1 is a vertical cross-sectional view illustrating a conventional vane rotary compressor.
Figure 2:
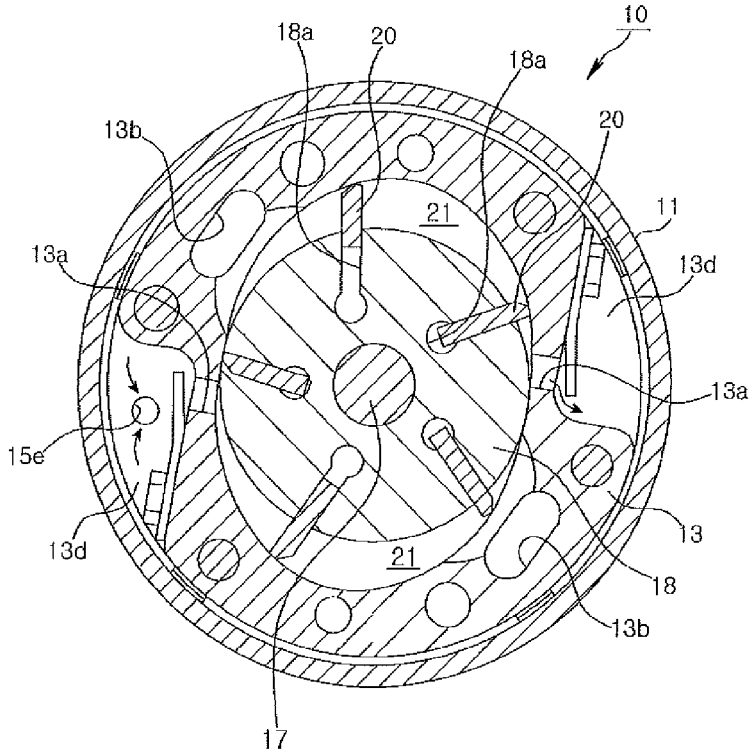
PRIOR ART FIG. 2
FIG. 2 is a cross-sectional view taken along line A-A in FIG. 1.
Figure 3:
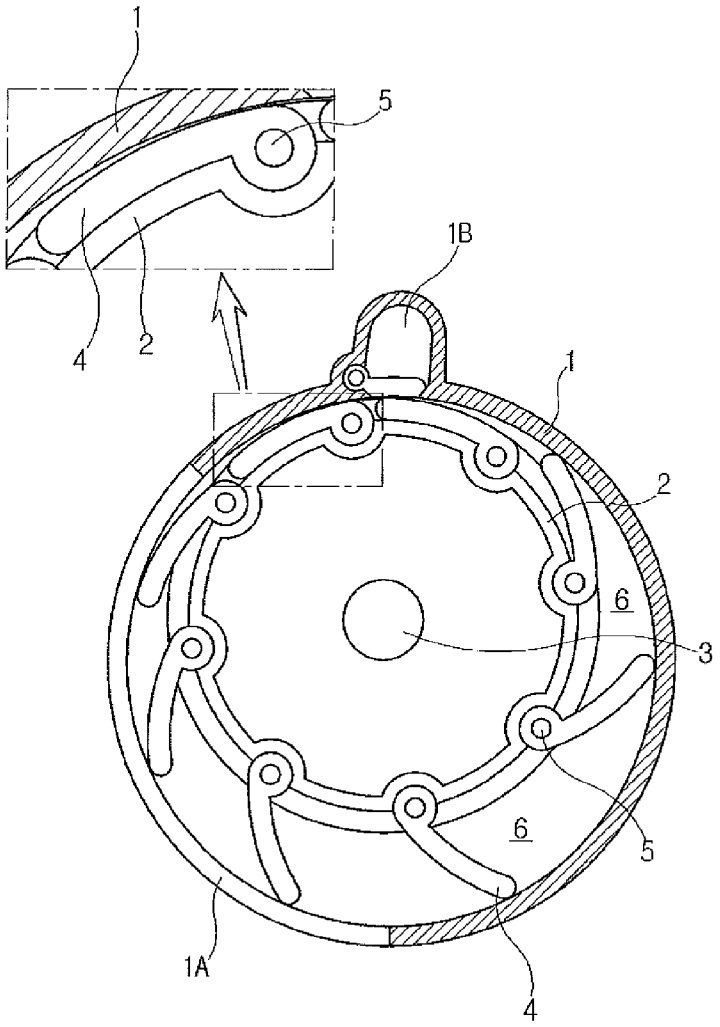
PRIOR ART FIG. 3
FIG. 3 is a horizontal cross-sectional view illustrating a conventional curved blade type vane rotary compressor.

Hereinafter, a vane rotary compressor according to exemplary embodiments of the present invention will be described with reference to the accompanying drawings. In the description, the thickness of each line or the size of each component illustrated in the drawings may be exaggerated for convenience of description and clarity.

In addition, the terms used herein are terms defined in consideration of functions of the present invention, and these may vary with the intention or practice of a user or an operator. Therefore, such terms should be defined based on the entire content disclosed herein.

Moreover, the following embodiments are for the purposes of illustratively describing the components set forth in the appended claims only and are not intended to limit the spirit and scope of the invention. More particularly, various variations and modifications are possible in concrete constituent elements of the embodiments, and it is to be understood that differences relevant to the variations and modifications fall within the spirit and scope of the present disclosure defined in the appended claims.

Embodiments

Figure 5:
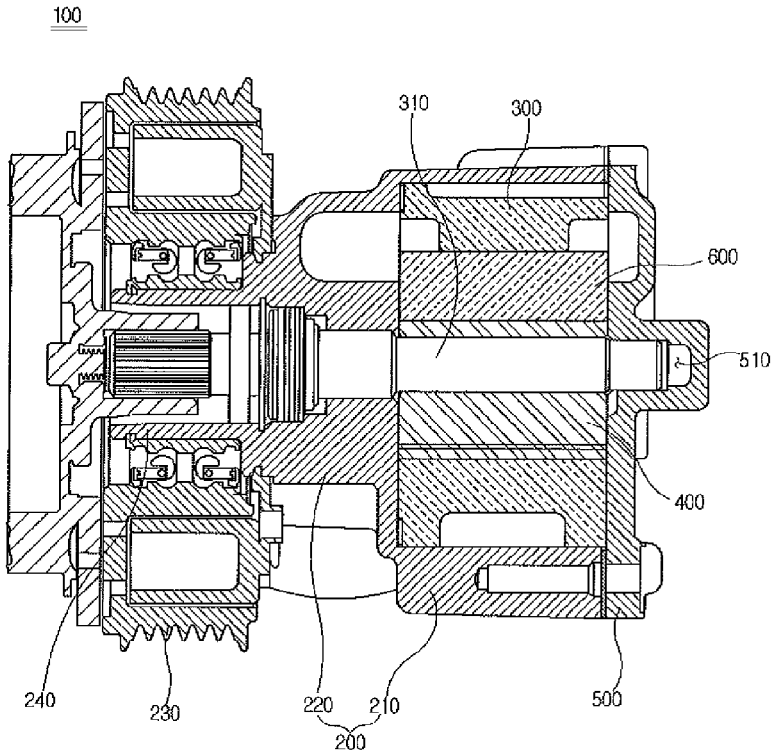
FIG. 5 is a vertical cross-sectional view illustrating a vane rotary compressor according to an embodiment of the present invention.

FIG. 5 is a vertical cross-sectional view illustrating a vane rotary compressor according to an embodiment of the present invention.

As illustrated in FIG. 5, the overall external appearance of a vane rotary compressor, which is designated by reference numeral 100 (hereinafter, referred to as "a compressor"), according to an embodiment of the present invention is defined by coupling of a housing 200 and a rear head 500.

The housing 200 includes a cylinder portion 210 which is formed therein with a space portion, and a front head portion 220 which closes the front of the space portion of the cylinder portion 210. The front head portion 220 is integrally formed with the cylinder portion 210 in the axial front thereof. In accordance with another example of the present invention, a housing may be integrally formed by the cylinder portion 210 and the rear head 500 to be described later and a separate front head may also be coupled to the front of the housing.

The space portion of the cylinder portion 210 is equipped with a hollow cylinder 300. In addition, the cylinder 300 is provided therein with a rotary shaft 310 which rotates by the power of a drive source (not shown), a rotor 400 which rotates along with the rotary shaft 310 by receiving torque from the rotary shaft 310, and a plurality of vanes 600 which are hinge-coupled to the outer peripheral surface of the rotor 400 to be rotatable in the radial direction of the rotor 400.

The rear head 500 is coupled to the axial rear of the housing 200 to close the rear of the space portion of the cylinder portion 210. A mounting groove 510 is formed at the inside center of the rear head 500, and the rear end of the rotary shaft 310 is inserted into and rotatably supported by the mounting groove 510. The front end of the rotary shaft 310 is rotatably supported by the hollow of the front head portion 220.

Meanwhile, the outer peripheral surface of the first head portion 220 of the housing 200 is provided with a suction port (not shown) for suction of a refrigerant from the outside and a discharge port (not shown) for discharge of a high-pressure refrigerant compressed within the cylinder 300 to the outside, which are circumferentially spaced apart from each other.

In addition, the front center of the first head portion 220 is extendedly formed with a pulley coupling portion 240 so as to couple a pulley 230 of an electronic clutch (not shown) thereto.

Figure 6:
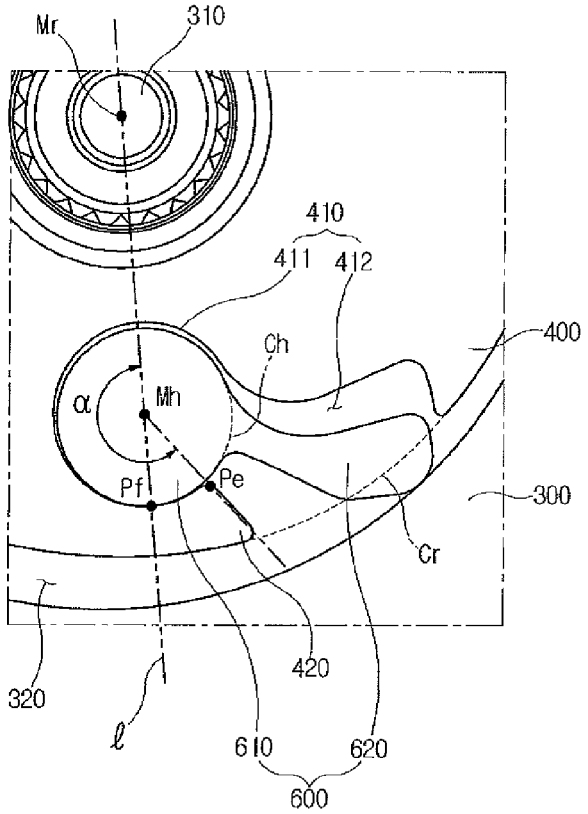
FIG. 6 is a view schematically illustrating a hinge portion of a vane and a hinge receiving portion of a rotor according to the embodiment of the present invention.
Figure 7:
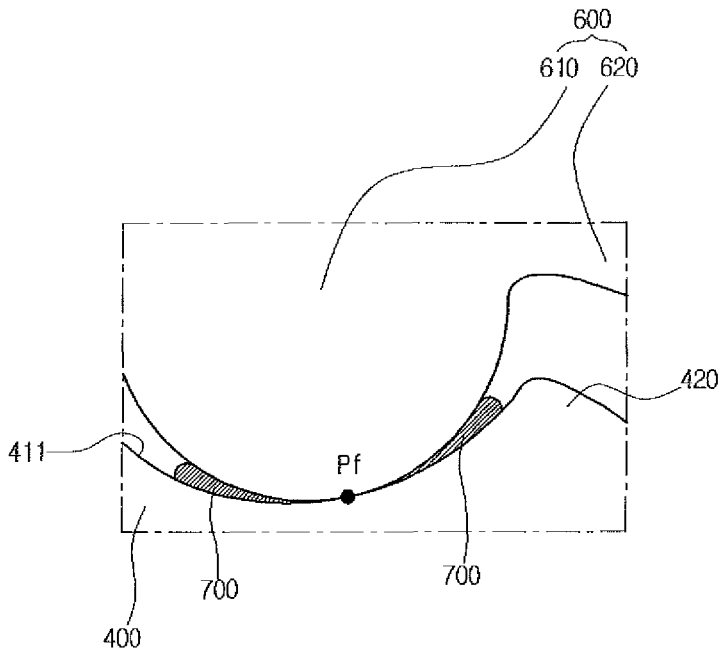
FIG. 7 is a partially enlarged view illustrating a state in which oil films are formed on both sides of a friction point of the vane hinge portion in FIG. 6 according to the embodiment of the present invention.

FIG. 6 is a view schematically illustrating a hinge portion 610 of the vane 600 and a hinge receiving portion 420 of the rotor 400 according to the embodiment of the present invention. FIG. 7 is a partially enlarged view illustrating a state in which oil films 700 are formed on both sides of a friction point Pf of the vane hinge portion 610 in FIG. 6 according to the embodiment of the present invention.

As illustrated in FIG. 6, the cylinder 300 is equipped therein with the rotary shaft 310 and the rotor 400 which are rotated by power of the drive source.

The rotor 400 is coupled to the rotary shaft 310, which is connected to a clutch (not shown) driven by a drive motor (not shown) or an engine belt (not shown), to axially rotate along with the rotary shaft 310. The rotary shaft 310 is mounted along the central axis of the cylinder 300.

The vanes 600 are spaced apart from each other and are hinge-coupled to the outer peripheral surface of the rotor 400. Each of the vanes 600 includes the hinge portion 610 which is hinge-coupled to one side of the outer peripheral surface of the rotor 400 and a blade portion 620 extending from one side of the hinge portion 610.

In this case, each compression chamber 320 is divided and formed by a space defined by the pair of adjacent vanes 600, the outer peripheral surface of the rotor 400, and the inner peripheral surface of the cylinder 300. The front and rear of the compression chamber 320 are sealed by the front head portion 220 (see FIG. 5) and the rear head 500 (see FIG. 5), respectively.

During the rotation of the rotor 400, the tip of the blade portion 620 of each of the vanes 600 rotates together in the rotation direction of the rotor 400 along the hollow inner peripheral surface of the cylinder 300. In this case, as the tip of the blade portion 620 of the vane 600 is close from an inlet (not shown) to an outlet (not shown), a gap between the outer peripheral surface of the rotor 400 and the hollow inner peripheral surface of the cylinder 300 is gradually narrowed, with the consequence that the volume of the compression chamber 320 is reduced and the refrigerant in the compression chamber 320 is compressed. For example, the hollow inner peripheral surface of the cylinder 300 may be formed in the form of an involute curve in which the width thereof is gradually decreased as being close from the inlet to the outlet.

In this case, in order to maximally reduce the volume of the compression chamber 320 during a compression stroke, one side of the outer peripheral surface of the rotor 400 preferably comes into close contact with the hollow inner peripheral surface of the cylinder 300 in the vicinity of the outlet. To this end, the outer peripheral surface of the rotor 400 is formed with a plurality of slots 410 which are formed in the same number as that of the vanes 600 to receive the vanes 600 and are spaced apart from each other in the circumferential direction. The vanes 600 are fully received in the slots 410 on the outer peripheral surface of the rotor 400 in the vicinity of the outlet.

Each of the slots 410 includes the hinge portion receiving groove 411 to which the hinge portion 610 of each vane 600 is hinge-coupled and a blade portion receiving groove 412 on which the blade portion 620 of the vane 600 is seated.

The hinge portion receiving groove 411 has a circular arc section shape such that the circle section shaped hinge portion 610 is inserted into and coupled to the hinge portion receiving groove 411. The blade portion receiving groove 412 has a shape corresponding to the blade portion 620 and is recessed on the outer peripheral surface of the rotor 400.

In accordance with the embodiment of the present invention, the hinge portion receiving groove 411 is radially inwardly spaced apart from the outer peripheral surface of the rotor 400. Thus, the overall circumference of the hinge portion 610 of the vane 600, which is hinge-coupled to the hinge portion receiving groove 411, is received inside the outer peripheral surface of the rotor 400. That is, a hinge portion imaginary circle Ch, which forms an outer peripheral surface of the hinge portion 610, is formed in an inner region of a rotor imaginary circle Cr, which forms the outer peripheral surface of the rotor 400, as illustrated in FIG. 6.

In this case, a hinge receiving portion 420 is extendedly formed on one side of the outer peripheral surface of the rotor 400 so as to enclose a radially outward circumference of the hinge portion receiving groove 411. Accordingly, the hinge portion 610 of the vane 600 is received radially inward of the hinge receiving portion 420.

Thus, the oil films 700 by oil viscosity are formed on both sides of the friction point, at which the hinge portion 610 comes into contact with the hinge receiving portion 420, so as to reduce friction resistance applied to the hinge portion 610 of the vane 600. Hereinafter, this description will be given in more detail.

When the vane 600 is unfolded during beginning of an intake stroke, the sum of forces acting on the vane 600 is concentrated on the friction point Pf at which the outer peripheral surface of the hinge portion 610 of the vane 600 comes into contact with the inner peripheral surface of the hinge portion receiving groove 411.

Figure 4:
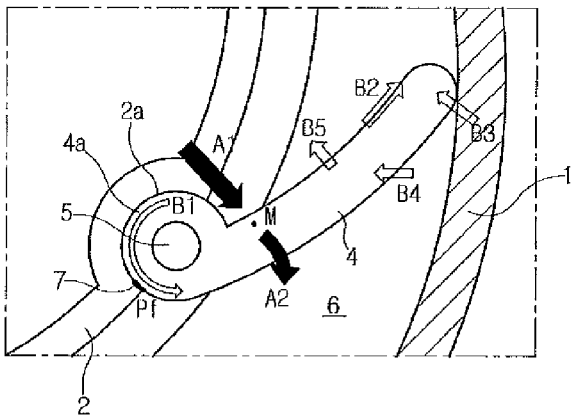
PRIOR ART FIG. 4
FIG. 4 is a partially enlarged view schematically illustrating forces acting on the vane during the rotation of a rotor in FIG. 3.

In the related art, since the friction point Pf between the hinge portion 4*a* and the hinge portion receiving groove 2*a* is formed at the end of the inner peripheral surface of the hinge portion receiving groove 2*a* as illustrated in FIG. 4, it is difficult to form the oil film 7 by the sliding surface and friction resistance is increased. Accordingly, this causes rotation operation of the vane 4 through the sliding motion of the hinge portion 4*a* to be delayed.

In accordance with the embodiment of the present invention, the friction point Pf of the hinge portion 610 is formed on an imaginary extension line l joining a central point Mr of the rotor 400 and a central point Mh of the hinge portion 610, and an end portion of the hinge receiving portion 420 passes the extension line l from one side of the outer peripheral surface of the rotor 400 in the rotation direction of the rotor 400 and extends to enclose the outside of the hinge portion 610.

That is, the friction point Pf, at which the outer peripheral surface of the hinge portion 610 comes into contact with the inner peripheral surface of the hinge portion receiving groove 411, is circumferentially inwardly spaced apart from an end Pe of the inner peripheral surface of the hinge portion receiving groove 411 by a predetermined interval.

In addition, a predetermined gap is formed between the outer peripheral surface of the hinge portion 610 and the inner peripheral surface of the hinge portion receiving groove 411, and the gap is divided into a plurality of oil film formation spaces on the basis of the friction point Pf.

On the basis of the friction point Pf, lubricant oil is preferably introduced into gaps of the front and rear of the hinge portion 610 in the rotation direction thereof so as to respectively from the oil films 700 in the gaps.

That is, in accordance with the embodiment of the present invention, the oil films 700 are formed by viscosity of the sliding surfaces on both sides of the friction point Pf so that the hinge portion 610 may smoothly slide, thereby preventing rotation operation of the vane 600 from being delayed.

Meanwhile, an angle $\alpha$, which is formed by the central point Mr of the rotor 400 and the end Pe of the inner peripheral surface of the hinge receiving portion 420 with respect to the central point Mb of the hinge portion 610, is preferably an obtuse angle between more than 180° and equal to or less than 230°. This is because it is difficult to form the oil films on both sides of the friction point Pf when the angle $\alpha$ is equal to or less than 180° and a rotatable angle of the vane 600 is restricted by the hinge receiving portion 420 to reduce compression efficiency when the angle $\alpha$ is more than 230°.

As described above, in accordance with the embodiment of the present invention, since the hinge receiving portion 420 is formed to enclose the outside of the hinge portion 610, the friction point Pf at which the outer peripheral surface of the hinge portion 610 comes into contact with the inner peripheral surface of the hinge portion receiving groove 411 is circumferentially inwardly spaced apart from the end Pe of the inner peripheral surface of the hinge portion receiving groove 411 by a predetermined interval. In this case, since the oil films 700 are respectively formed on both sides of the friction point Pf, the hinge portion 610 may smoothly slide and rotation operation of the vane 600 may be prevented from being delayed.

Figure 8:
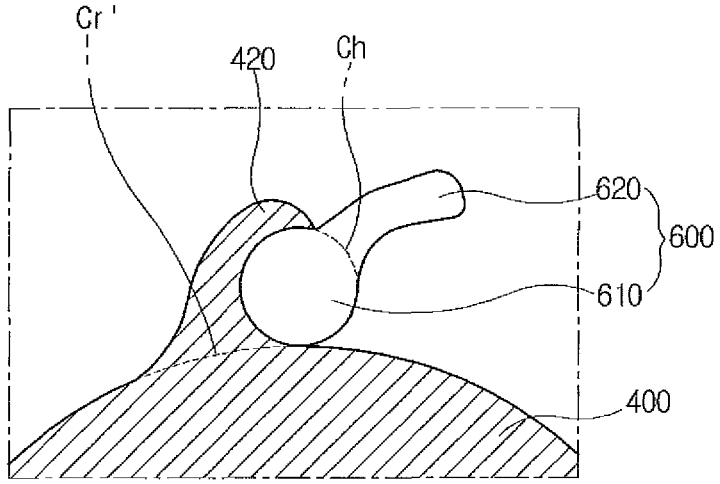
FIG. 8 is a partial view schematically illustrating an example of a hinge receiving portion according to another embodiment of the present invention.

Meanwhile, FIG. 8 is a partial view schematically illustrating an example of three binge receiving portion 420 according to another embodiment of the present invention.

In the above-mentioned embodiment, the overall region of the hinge portion 610 is received inside the outer peripheral surface of the rotor 400 and this state may be identified by the hinge portion imaginary circle Ch being formed in the inner region of the rotor imaginary circle Cr, as illustrated in FIG. 6.

In accordance with another embodiment of the present invention, the overall region of the hinge portion 610 may also be arranged outside the outer peripheral surface of the rotor 400 as illustrated in FIG. 8. That is, a hinge portion imaginary circle Ch may also be formed in an outer region of a rotor imaginary circle Cr'. In this case, the hinge receiving portion 420 protrudes outward from the outer peripheral surface of the rotor 400 and encloses the circumference of the hinge portion 610.

In accordance with another embodiment of the present invention, the friction point Pf between the hinge portion 610 and the hinge receiving portion 420 is formed on the extension line l joining the central point Mr of the rotor 400 and the central point Mh of the hinge portion 610. Accordingly, oil films are respectively formed in the front and rear of the hinge portion 610 in the rotation direction thereof on the basis of the friction point Pf, thereby enabling a reduction in the hinge friction force B1 (see FIG. 4) of the vane 600.

INDUSTRIAL APPLICABILITY

In accordance with the vane rotary compressor 100 according to an embodiment of the present invention, the oil films 700 are formed on both sides of the friction point Pf between the hinge portion 610 of the vane 600 and the hinge receiving portion 420 of the rotor 400.

In this case, since two sliding surfaces are formed on each of the both sides of the friction point Pf, it may be possible to reduce friction force by the oil films 700 and to prevent generation of strike noise due to a delay of rotation operation of the vane 600.

Moreover, it may be possible to enhance performance of the compressor by preventing an inner leakage due to the delay of rotation operation of the vane.

Various embodiments have been described in the best mode for carrying out the invention. Although the present invention has been described with respect to the illustrative embodiments, it will be apparent to those skilled in the art that various variations and modifications may be made without departing from the spirit and scope of the invention as defined in the following claims.

The invention claimed is:

1. A vane rotary compressor comprising:

a housing having a hollow cylinder formed therein;

a rotor rotatingly disposed in the cylinder and coupled to a rotary shaft, the rotor including a plurality of slots and a plurality of hinge receiving portions formed on an outer peripheral surface of the rotor; and a plurality of vanes dividing the cylinder into a plurality of compression chambers, each of the plurality of vanes including a hinge portion and a blade portion extending outwardly from the hinge portion, the hinge portion received within one of the plurality of slots, the blade portion biasing towards an inner peripheral surface of the cylinder, each of the plurality of hinge receiving portions enclosing a circumference of the hinge portion of each of the plurality of vanes, the hinge portion of each of the plurality of vanes contacts the rotor at a friction point inwardly spaced from an end of each of the plurality of hinge receiving portions, the end of each of the plurality of hinge receiving portions extending beyond an extension line passing through a central point of the rotor and a central point of the hinge portion, each of the plurality of hinge receiving portions extending along the circumference of the hinge portion in a direction of rotation of the rotor.

2. The vane rotary compressor of claim 1, wherein an obtuse angle formed between the extension line extending between the central point of the rotor and the central point of the hinge portion and a line extending from the central point of the hinge portion and along the end of one of the plurality of hinge receiving portions is between 180 degrees and 230 degrees.

3. The vane rotary compressor of claim 1, wherein a gap is formed between the hinge portion and each of the plurality of hinge receiving portions on each side of the friction point, and wherein an oil film forms in each of the gaps.

4. The vane rotary compressor of claim 1, wherein the friction point divides a gap formed between an inner peripheral surface of each of the plurality of hinge receiving portions and an outer peripheral surface of the hinge portion into a plurality of oil film formation spaces.

5. A vane rotary compressor comprising:

a housing having a hollow cylinder formed therein;

a rotor rotatingly disposed in the cylinder and coupled to a rotary shaft, the rotor including a plurality of slots formed on an outer peripheral surface of the rotor; and a plurality of vanes dividing the cylinder into a plurality of compression chambers, each of the plurality of vanes including a hinge portion and a blade portion extending outwardly from the hinge portion, the hinge portion received within one of the plurality of slots, the blade portion biasing towards an inner peripheral surface of the cylinder, the hinge portion contacting an inner peripheral surface of the rotor at a friction point, the friction point disposed on an extension line passing through a central point of the rotor and a central point of the hinge portion.

6. The vane rotary compressor of claim 5, wherein a plurality of hinge receiving portions are formed on the outer peripheral surface of the rotor, each of the plurality of hinge receiving portions enclosing a circumference of the hinge portion of each of the plurality of vanes.

7. The vane rotary compressor of claim 6, wherein a gap is formed between an inner peripheral surface of each of the plurality of hinge receiving portions and an outer peripheral surface of the hinge portion of each of the plurality of vanes, a plurality of oil film formation spaces formed in each of the gaps.

8. The vane rotary compressor of claim 7, wherein the plurality of oil film formation spaces are separated from each other by the friction point.

9. The vane rotary compressor of claim 6, wherein a gap is formed between the hinge portion of each of the plurality of vanes and each of the plurality of hinge receiving portions on each side of the friction point, and wherein an oil film forms in each of the gaps.

10. The vane rotary compressor of claim 5, wherein a hinge portion imaginary circle extends along an outer peripheral surface of the hinge portion of each of the plurality of vanes and a rotor imaginary circle extends along the outer peripheral surface of the rotor, and wherein the hinge portion imaginary circle is disposed in an inner region of the rotor imaginary circle.

11. The vane rotary compressor of claim 5, wherein a hinge portion imaginary circle extends along an outer peripheral surface of the hinge portion of each of the plurality of vanes and a rotor imaginary circle extends along the outer peripheral surface of the rotor, and wherein the hinge portion imaginary circle is disposed in an outer region of the rotor imaginary circle.

12. A vane rotary compressor comprising:

a housing having a hollow cylinder formed therein;

a rotor rotatingly disposed in the cylinder and coupled to a rotary shaft, the rotor including a plurality of slots formed on an outer peripheral surface of the rotor, each of the slots having a hinge portion receiving groove formed inwardly from the outer peripheral surface of the rotor, the rotor further including a plurality of hinge receiving portions formed on the outer peripheral surface of the rotor; and a plurality of vanes dividing the cylinder into a plurality of compression chambers, each of the plurality of vanes including a hinge portion and a blade portion extending outwardly from the hinge portion, the hinge portion received within one of the plurality of slots, the blade biasing towards an inner peripheral surface of the cylinder, a circumference of the hinge portion received inside the outer peripheral surface of the rotor, the hinge portion of each of the plurality of vanes contacts the rotor at a friction point inwardly spaced from an end of each of the plurality of hinge receiving portions, the end of each of the plurality of hinge receiving portions extending beyond an extension line passing through a central point of the rotor and a central point of the hinge portion, each of the plurality of hinge receiving portions extending along the circumference of the hinge portion in a direction of rotation of the rotor.

13. The vane rotary compressor of claim 12, wherein each of the plurality of hinge receiving portions encloses the circumference of the hinge portion of each of the plurality of vanes.

14. The vane rotary compressor of claim 13, wherein an obtuse angle formed between the extension line extending between the central point of the rotor and the central point of the hinge portion and a line extending from the central point of the hinge portion and along an end of one of the plurality of hinge receiving portions is between 180 degrees and 230 degrees.

15. The vane rotary compressor of claim 12, wherein a gap is formed between the hinge portion and each of the plurality of hinge receiving portions on each side of the friction point, and wherein an oil film forms in each of the gaps.

16. The vane rotary compressor of claim 12, wherein the friction point is disposed on the extension line passing through the central point of the rotor and the central point of the hinge portion.

* * * * *